US011158926B2

(12) United States Patent
Zhao et al.

(10) Patent No.: US 11,158,926 B2
(45) Date of Patent: Oct. 26, 2021

(54) ANTENNA STRUCTURE, FOR DIFFERENT RANGE COMMUNICATION MODES

(71) Applicant: SIGNIFY HOLDING B.V., Eindhoven (NL)

(72) Inventors: Wei Hong Zhao, Eindhoven (NL); Peiliang Dong, Eindhoven (NL); You Li, Eindhoven (NL); Liang Shi, Eindhoven (NL); Gang Wang, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/610,745

(22) PCT Filed: May 1, 2018

(86) PCT No.: PCT/EP2018/061077

§ 371 (c)(1),
(2) Date: Nov. 4, 2019

(87) PCT Pub. No.: WO2018/206343

PCT Pub. Date: Nov. 15, 2018

(65) Prior Publication Data

US 2020/0161739 A1 May 21, 2020

(30) Foreign Application Priority Data

Jul. 3, 2017 (EP) ..... 17179385

(51) Int. Cl.
*H01Q 1/06* (2006.01)
*H01Q 7/00* (2006.01)
(Continued)

(52) U.S. Cl.
CPC ..... *H01Q 1/06* (2013.01); *H01Q 1/22* (2013.01); *H01Q 7/005* (2013.01); *H05B 47/19* (2020.01)

(58) Field of Classification Search
CPC ..... H01Q 7/00; H01Q 7/005; H01Q 1/06; H01Q 1/2208; H01Q 3/247
See application file for complete search history.

(56) References Cited

U.S. PATENT DOCUMENTS 6,304,230 B1 * 10/2001 Panther ..... H01Q 1/3275 343/742
8,288,893 B2 * 10/2012 Cook ..... G06K 19/07749 307/98

(Continued)

FOREIGN PATENT DOCUMENTS

WO 2013147823 A1 10/2013

*Primary Examiner* — Jason Crawford

(57) ABSTRACT

The invention provides an antenna structure comprising a plurality of wire segments formed in a loop. Connecting units are provided between the wire segments, each of which is switchable between a conductive state and a reactive state. With the connecting units in the conductive state a loop antenna is formed with a first (longer) signal range and with the connecting units in the reactive state an antenna structure is formed with a second (shorter) signal range. Said reactive state is adapted to introduce a phase delay between the adjacent wire segments. This enables the same antenna to be used for long range signal communication and short range communication, for example for system configuration or commissioning. The antenna structure may be used with luminaires of a lighting system.

15 Claims, 5 Drawing Sheets

(51) Int. Cl.
*H05B 47/19* (2020.01)
*H01Q 1/22* (2006.01)

(56) References Cited

U.S. PATENT DOCUMENTS

| | | | | |
|---|---|---|---|---|
| 8,581,588 | B2 * | 11/2013 | Driesel | G01R 33/345 324/322 |
| 10,985,465 | B2 * | 4/2021 | Singh | H04B 5/0081 |
| 2003/0156069 | A1 * | 8/2003 | Ooe | H01Q 3/247 343/713 |
| 2008/0231526 | A1 * | 9/2008 | Sato | H01Q 1/243 343/722 |
| 2009/0009295 | A1 | 1/2009 | Rofougaran | |
| 2010/0279734 | A1 | 11/2010 | Karkinen et al. | |
| 2013/0135164 | A1 * | 5/2013 | Asanuma | H01Q 9/26 343/749 |
| 2015/0044963 | A1 * | 2/2015 | Konanur | H01Q 1/2291 455/41.1 |
| 2017/0040691 | A1 * | 2/2017 | Singh | H02J 7/025 |

* cited by examiner

ANTENNA STRUCTURE, FOR DIFFERENT RANGE COMMUNICATION MODES

CROSS-REFERENCE TO PRIOR APPLICATIONS

This application is the U.S. National Phase application under 35 U.S.C. § 371 of International Application No. PCT/EP2018/061077, filed on May 1, 2018, which claims the benefit of European Patent Application No. 17179385.4, filed on Jul. 3, 2017, and Chinese Patent Application No. PCT/CN2017/083782, filed on May 10, 2017. These applications are hereby incorporated by reference herein.

FIELD OF THE INVENTION

This invention relates to an antenna structure which enables different range communication modes to be established.

BACKGROUND OF THE INVENTION

Different communication modes are for example used for commissioning a wireless communication system and for subsequent use of the system. During commissioning, there is for example short range communication between an installer of the system and each individual unit within the system, in order to configure each individual unit. During subsequent use of the system, the units communicate with each other or a central controller over a longer range.

By way of example, wireless communication and control functions may be embedded into luminaires, lighting modules or other traditional equipment to enable wireless functionality of these products.

This functionality is implemented by adding an RF module and its associated antenna to these products. However, often the RF module and its associated antenna are not suitable for commissioning purposes, because the commissioning of the luminaire is preferred to be restricted to the near field for security reasons. Thus, commissioning based on a typical 2.4 GHz antenna is a challenge.

Increasingly, luminaires and other lighting modules have wireless connectivity for system communication as well as a near field commissioning function to be carried out at the same time. For this purpose, an RF module with its antenna is supplemented with a near field commissioning part such as a near field communication (NFC) system. Thus, there is often a need to design two separate antennae, one typically in the form of a 2.4 GHz antenna, and the other in the form of a near field commissioning coil at very different frequency. Two separate antennae require more PCB area, whereas it is difficult to place a large PCB into many types of product, such as luminaires.

US 2009/0009295 discloses an antenna structure which can be used for far field and near field communication. The antenna is based on a large coil, and the coil acts as a near field antenna using a low frequency signal. By adding some switches to the coil, some segments of the coil act as a far field antenna for a high frequency signal (at microwave frequencies). There are then two different transceiver systems to receive the near field and far field communications. This arrangement also requires many additional components. Thus, there remains a need for a system which enables long range and short range wireless communication with a simple structure.

WO2013147823A1 discloses an antenna pattern with inductors connecting the antenna element. For NFC related functions, the inductors becomes short circuit at 13.56 MHz NFC frequency, and all elements connect to each other directly; and for WLAN operation, the inductors include high impedance ("all most act as an open circuit") at 2.4 GHz WLAN frequency thus the elements are decoupled.

US20100279734A1 discloses that the antenna ANTI is used for NFC and other long range communications like FM, GPS "in a first mode signals (RFID) to or from the first and second ports resonate along the whole of the antenna and in a second mode signals (any one or more of Bluetooth/WLAN/GPS/FM) to or from the third port resonate along a portion of the antenna in which the portion terminates at the impedance.

SUMMARY OF THE INVENTION

The invention is based on the concept of providing an antenna structure which may operate over different signal ranges with a simplified configuration. In preferred examples, the antenna structure uses the same frequency for the different communications, for example based on a 2.4 GHz loop antenna. The antenna makes use of switchable elements so that the antenna configuration can be changed electrically.

A basic idea of embodiments of the invention is using a long loop antenna for far field communication, and using reactive components such as capacitor to segment the long loop such that some far field radiations cancel with each other and the antenna becomes a near field antenna. The reactive components are switchable in or out, such that the antenna is switchable between far field and near field modes of operation.

The invention is defined by the claims.

According to examples in accordance with an aspect of the invention, there is provided an antenna structure comprising:

a plurality of wire segments formed in a loop;

a plurality of connecting units adapted to connect the plurality of wire segments, each of said connecting units being switchable between a conductive state and a reactive state, wherein said reactive state is adapted to introduce a phase delay between the adjacent wire segments;

wherein the antenna structure is switchable between a first and second mode of operation, wherein in said first mode, the connecting units are adapted to be in the conductive state thereby connecting the wire segments to form a loop antenna with a first signal range, and wherein in said second mode, the connecting units are adapted to be in the reactive state thereby to form an antenna structure with a second signal range smaller than the first signal range.

This antenna structure can be switched between a long range and a short range mode of operation. Thus, a single antenna structure may be used for multiple functions within a device. When the connecting units are in their conductive mode, a continuous long range loop antenna is formed. When the connecting units are in their reactive mode, a discontinuous structure is formed, which has a shorter range.

The smaller, second signal range enables communication with increased security. The second signal range is for example 1 meter or less, whereas the first signal range is typically 10 meters or more (depending on the application environment).

The antenna structure is for example for transmitting or receiving signals in a frequency band, wherein the frequency band is the same for the first and second modes. The two modes of operation are for the same frequency band, so that a same receiver may communicate using the antenna for both the short range and long range modes.

The frequency band for example includes 2.4 GHz. This is a band suitable for popular wireless control and communication within a network of devices, such as luminaires of a lighting system. At present, Zigbee and WiFi are based on this band.

The first mode is for example a long range communication mode and the second mode is a near field commissioning mode. Thus, the antenna structure enables multiple modes to be implemented within a system, so that the shared structure may be used for initial commissioning and for subsequent system use.

The reactive state for example defines a capacitive coupling. Thus, the connecting units may comprise series capacitors.

Each connecting unit may for example comprise a parallel connection of an RF switch and a capacitor, wherein the RF switch is adapted to be closed to set the connecting unit in the conduction state, and open to set the connecting unit in the reactive state.

The closed state of the switch bypasses the capacitor and thus forms a continuous loop antenna for conventional RF communication.

The antenna structure may further comprise an antenna feeding point on the loop, wherein one of the connecting units is opposite to the antenna feeding point on the loop, and further comprises a resistor in parallel with said capacitor. This different design of connecting unit opposite the feeding point guarantee the input port impedance matching.

Each connecting unit is for example formed on a double layer printed circuit board, wherein the RF switch is formed in a first layer of the printed circuit board, and the capacitor is formed in a second layer of the printed circuit board, and the RF switch and the capacitor are connected by a metalized via arrangement through the printed circuit board.

This provides a compact implementation of the structure of the connecting units on the PCB.

In a preferred embodiment, each RF switch is for example a diode. To implement the conductive mode, a DC voltage may be applied sufficient to turn on the diode and switch the connecting units to the conductive state, whereas a lower DC voltage may be applied for the reactive state. Thus, the switching units may be switched based on a DC forward voltage applied to them.

In one set of examples, each diode is a light emitting diode of a LED chip thereby to form an integrated light source and antenna architecture. The antenna structure is thus part of a lighting unit such as a luminaire. The diodes perform the dual function of providing the desired light output, as well as functioning as the interconnecting elements of the antenna structure. This provides a low cost and compact solution for a lighting unit with a wireless communication and commissioning capability. Components which are already present as part of the lighting system are used as switchable antenna elements. The LED diode function may be used based on a DC voltage level applied. If a DC voltage exceeds the LED string voltage, the LEDs are turned on to emit light but also conduct to bypass the reactive elements.

The wire segments for example comprise the wiring between LED chips, which wiring is adapted to carry the LED chip current.

The antenna structure may further comprise a controller for controlling the connecting units to be in the first or second mode, wherein said controller is for providing a bias DC voltage across the diode higher than a forward voltage of the diodes so as to control the connecting units to be in the conductive state, or otherwise to be in the reactive state, and a communication circuit for applying, upon the bias DC voltage, an AC signal component for communication using the loop antenna with the first signal range in the first mode.

An LED lighting circuit may comprise:

the antenna structure as defined above having LEDs as the connecting units;

a dimming interface to receive a dimming signal; and an additional set of LED chips;

wherein the LED lighting circuit is adapted to turn on the LED chips in the antenna structure so as to emit light and enable communication in the first signal range, and turn on or off the additional set of LED chips according to said dimming signal.

The LEDs of the antenna structure may thus be permanently on when long range communication is desired, and other LED chips may be controlled for implementing a dimming function.

The invention also provides an LED lamp, comprising the LED lighting circuit as defined above.

Examples in accordance with another aspect of the invention provide a communications method, comprising:

providing an antenna structure comprising:

a plurality of wire segments formed in a loop; and a plurality of connecting units adapted to connect the plurality of wire segments, each of said connecting units being switchable between a conductive state and a reactive state, wherein said reactive state is adapted to introduce a phase delay between the adjacent wire segments, wherein the method comprises:

in a first mode of operation, controlling the connecting units to be in their conductive state thereby connecting the wire segments to form a loop antenna with a first signal range, and communicating over the first signal range; and in a second mode of operation, controlling the connecting units to be in their reactive state thereby to form an antenna structure with a second signal range smaller than the first signal range, and communicating over the second signal range.

Communicating in the first and second modes of operation is preferably in the same frequency band such as including 2.4 GHz. The first mode is preferably a long range communication mode and the second mode is a near field commissioning mode. These and other aspects of the invention will be apparent from and elucidated with reference to the embodiment(s) described hereinafter.

BRIEF DESCRIPTION OF THE DRAWINGS

Examples of the invention will now be described in detail with reference to the accompanying drawings, in which.

DETAILED DESCRIPTION OF THE EMBODIMENTS

The invention provides an antenna structure comprising a plurality of wire segments formed in a loop. Connecting units are provided between the wire segments, each of which is switchable between a conductive state and a reactive state. With the connecting units in the conductive state a loop antenna is formed with a first (longer) signal range and with the connecting units in the reactive state an antenna structure is formed with a second (shorter) signal range. This enables the same antenna to be used for long range signal communication and short range communication, for example for system configuration or commissioning. The antenna structure may be used with luminaires of a lighting system.

Figure 1:
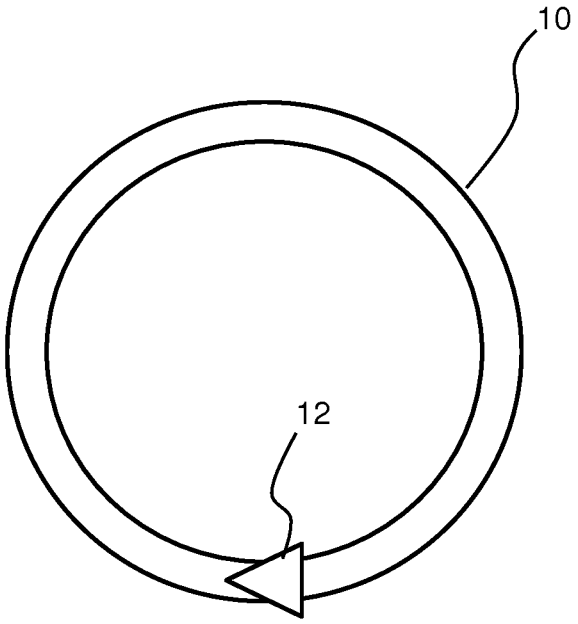
FIG. 1 shows a basic RF loop antenna.

FIG. 1 shows a basic RF loop antenna, for example for 2.4 GHz communication.

The antenna comprises a loop 10, with a feed point 12. The loop diameter is 19 mm.

Figure 2:
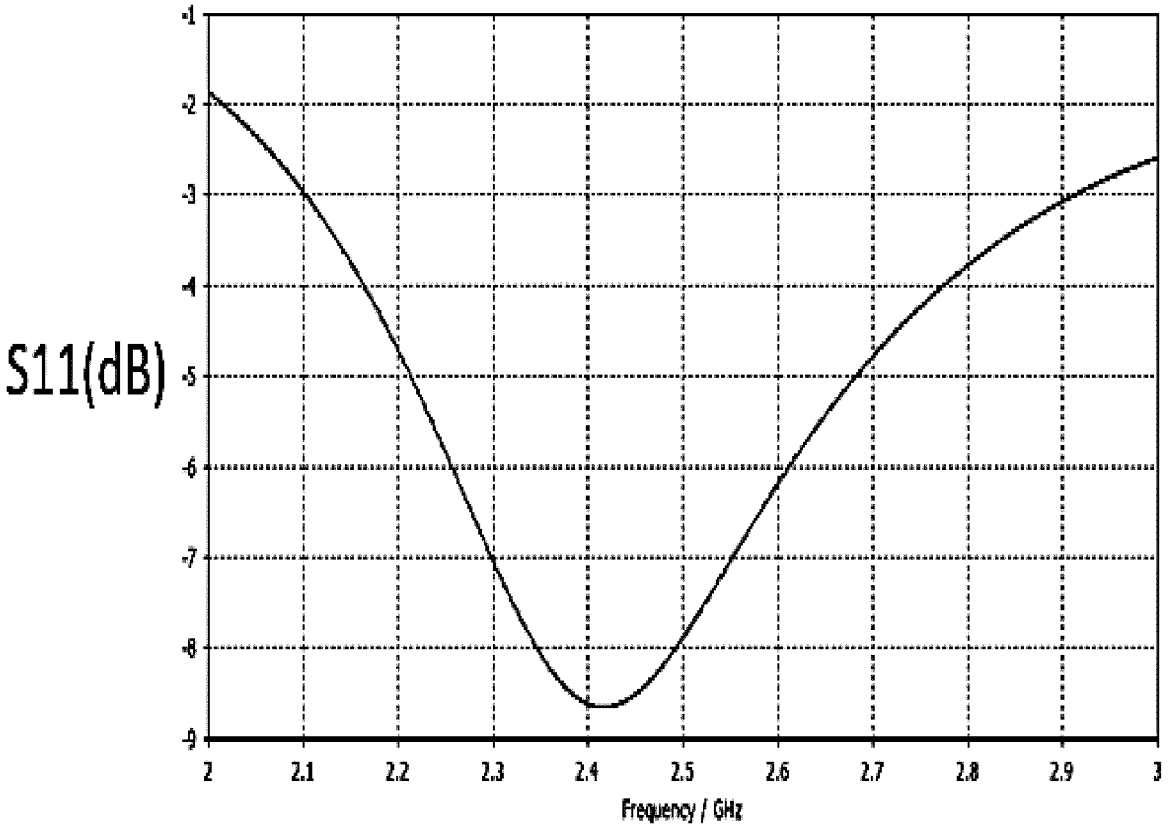
FIG. 2 shows the antenna performance as the S11 return loss value versus frequency.

FIG. 2 shows the antenna performance as the S11 return loss value versus frequency, showing a minimum loss at 2.4 GHz.

Figure 3:
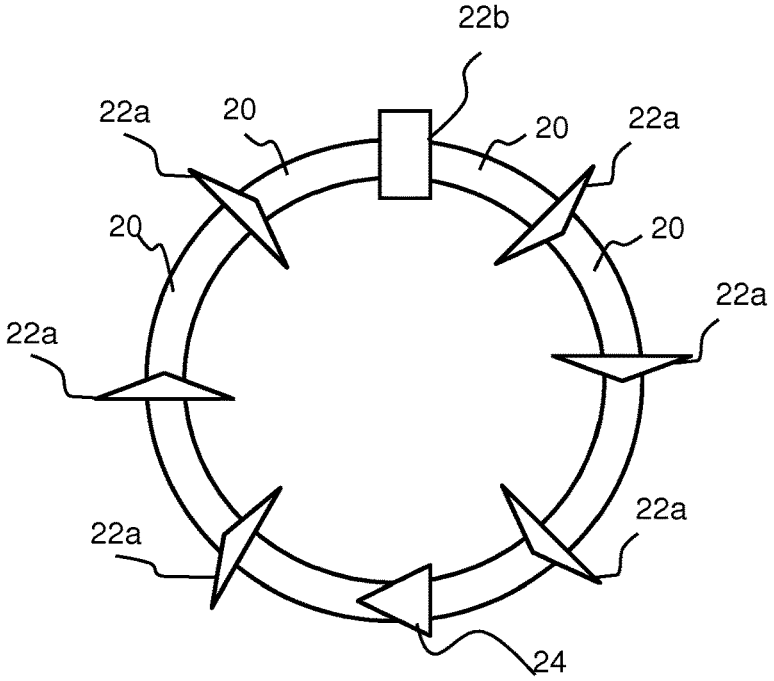
FIG. 3 shows a modified version of the loop antenna.

FIG. 3 shows a modified version of the loop antenna.

The antenna structure comprises a plurality of wire segments 20 formed in a loop. A plurality of connecting units 22 connect the plurality of wire segments, and these have a capacitance.

The connecting units may all be the same, for example series capacitors of capacitance less than 0.2 pF.

However, in FIG. 3, there are two types of connecting units. A first type 22*a* comprises series capacitors of capacitance less than 0.2 pF, and the second type 22*b* is a parallel combination of a 0.2 pF capacitor and a 43Ω resistor. The feeding point 24 is opposite the connecting unit 22*b*.

Figure 4:
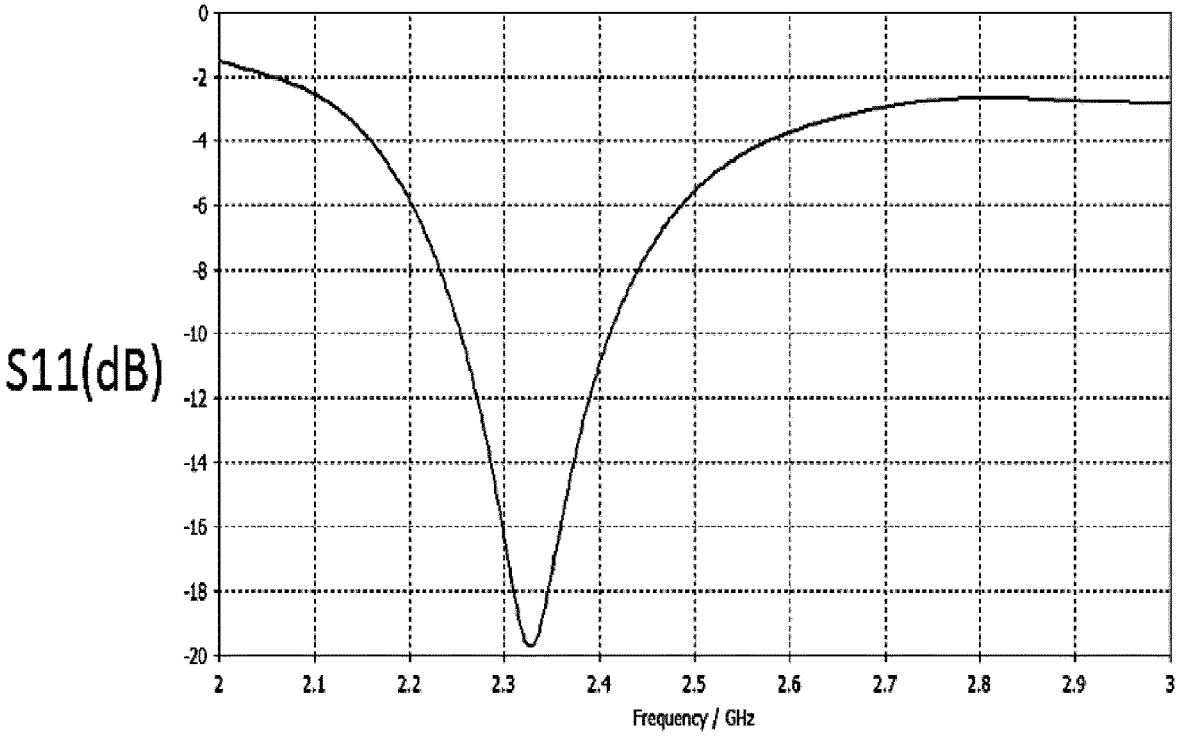
FIG. 4 shows the antenna performance as the S11 return loss value versus frequency.

FIG. 4 shows the antenna performance as the S11 return loss value versus frequency. It shows a minimum loss which is still near 2.4 GHz but with an overall greater return loss.

For the conventional loop antenna of FIG. 1, the perimeter of the loop antenna is comparable to the operating wavelength. This means the current distribution along the loop experiences phase-inversion and current nulls. The magnetic field produced by the antenna is relatively weak in certain regions.

When segmented line sections are provided, they introduce a very small phase delay between the adjacent sections so that the current flowing along the segmented loop is kept in a single direction even though the perimeter of the segmented loop antenna is comparable to the operating wavelength. In this way, the current distribution for the segmented loop looks appears to be in phase. In this way, the segmented design is able to produce a more uniform magnetic field distribution even though the loop is electrically large.

The near field performance is influenced by the number of segments and the capacitance of the connecting units. Preferably, there are at least 8 segments. The aim is to obtain a loop current flow, which results in the near field antenna function. This loop current flow is obtained only once a number of segments has been reached, which will depend on the antenna size and operating frequency. It has been found that at least 8 segments provides the required near field operation for the preferred 2.4 GHz implementation. More segments may be used, but additional segments introduce additional complexity to the design by requiring additional components.

The capacitance value is also selected to ensure the loop current will flow. Furthermore, for the 2.4 GHz example, the near field loop resonant frequency needs to be close to 2.4 GHz, and this also influences the capacitance value.

From experimentation, the following results are obtained:

| No. of segments | Capacitance at which loop current flows | Capacitance for resonance near 2.4 GHz |
|---|---|---|
| 8 | C < 0.4 pF | C = 0.2 pF, 2.64 GHz |
| 10 | C < 0.6 pF | C = 0.2 pF, 2.33 GHz |
| 12 | C < 0.6 pF | C = 0.4 pF, 2.42 GHz |

Figure 5:
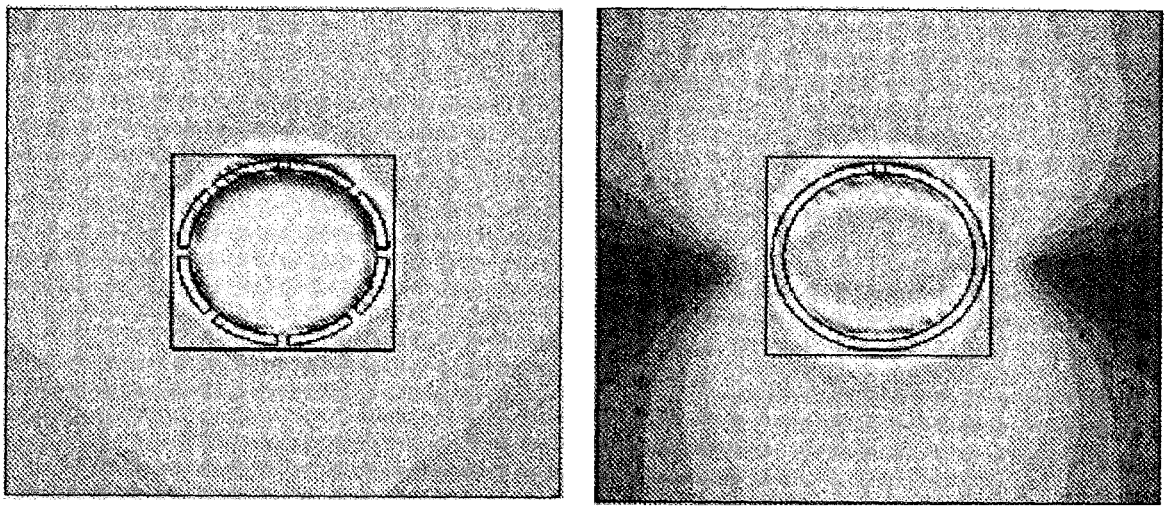
FIG. 5 shows the magnetic field distribution pattern for the conventional loop antenna on the left and for the segmented antenna on the right, in plan view.

FIG. 5 shows the magnetic field distribution pattern for the conventional loop antenna on the left and for the segmented antenna on the right, in plan view. The segmented design has a more uniform intensity but the intensity is lower, and very weak at long range.

Figure 6:
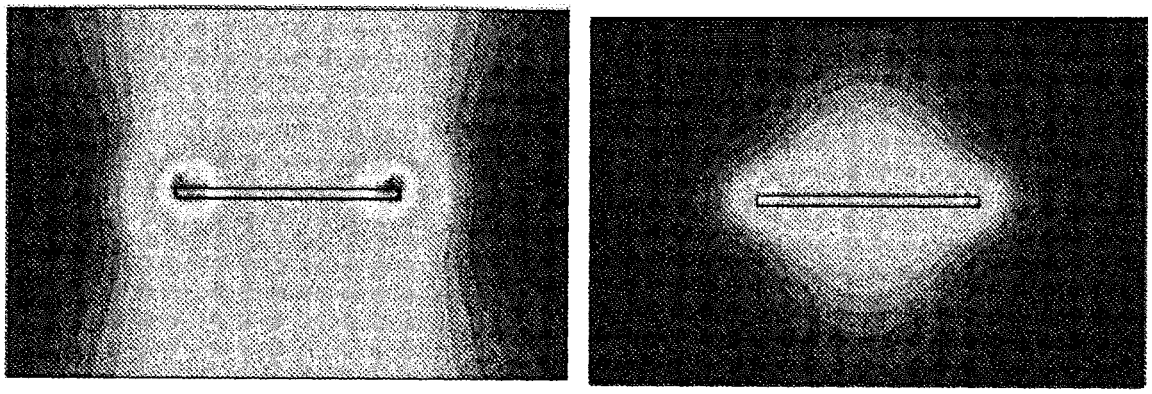
FIG. 6 shows the power flow distribution pattern for the conventional loop antenna on the left and for the segmented antenna on the right, viewed in cross section through the loop.

FIG. 6 shows the power flow distribution pattern for the conventional loop antenna on the left and for the segmented antenna on the right, viewed in cross section through the loop (perpendicular to the loop plane).

FIG. 6 shows that the power reaches far away for the basic loop antenna, but is restricted to the near field for the modified segmented design.

The invention is based on an antenna design which uses both of these characteristics. The segmented design is used for near field communication, for example for a commissioning mode of operation, and the conventional design is used for far field communication. Thus, within a single antenna design, the two performance characteristics explained above are combined.

To enable this dual function, the connecting units are switchable between a conductive state and a reactive state. The reactive state defines the capacitances, and the conducting state defines a short circuit between the wire segments, thereby forming the basic closed loop.

Figure 7:
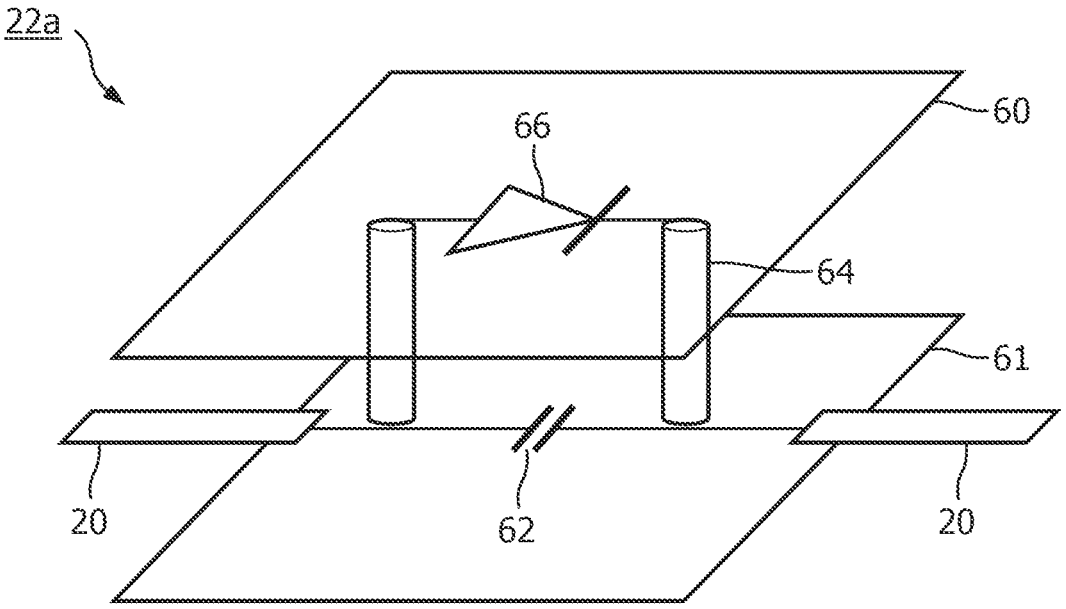
FIG. 7 shows an example of a connecting unit 22*a;*

FIG. 7 shows an example of a connecting unit 22*a*. The connecting unit is formed on a double-layer PCB having a first, front level 60 and a second, back level 61 which carries the wire segments 20. A capacitor 62 is formed on the PCB back level 61, for example of 0.2 pF.

Figure 10:
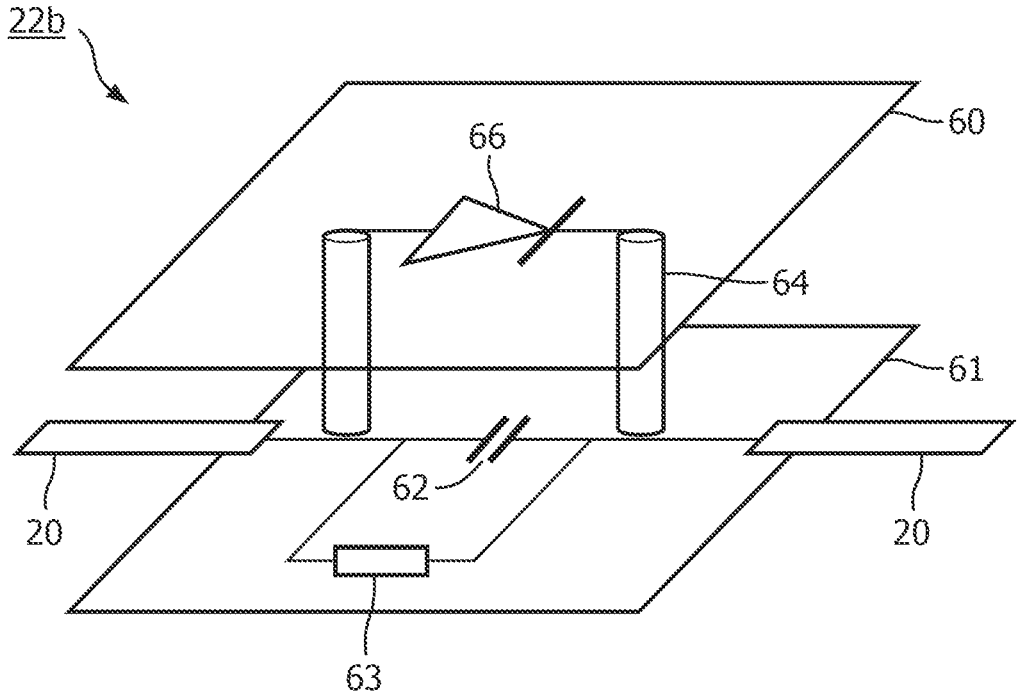
FIG. 10 shows an example of a connecting unit 22*b*.

FIG. 10 shows an example of a connecting unit 22*b*, which is almost the same as the connecting element 22*a* shown in FIG. 7, except for that it further comprises a resistor 63 in parallel with the capacitor 62.

Metallized vias 64 connect the capacitor 62 to an RF switch 66 carried by the first PCB level 60. Thus, the connecting unit comprises a parallel connection of an RF switch 66 and a capacitor 62.

The RF switch is closed to set the connecting unit in the conduction state during which the capacitor is bypassed, and open to set the connecting unit in the reactive state during which the capacitor is in series between the wire segments. Thus, when the RF switch is closed, the segmented line sections are connected together to function as the 2.4 GHz loop antenna model, all on the single PCB layer 60. When the RF switch is open, the signal passes along the second PCB level 61, i.e. to the back level, and the capacitor implements the near field commissioning model.

The connecting unit 22*b* (with a parallel resistor as well) may be formed by providing a resistor in parallel with the RF switch 66 on the second PCB layer 68.

Of course, the front and back levels may be the other way around, with the wire segments and diodes on the same level and the capacitors on the other level.

The RC connecting unit 22*b* may be used at the position opposite the feeding point to improve the near field mode performance. It may however not be needed.

The RF switch 66 is shown as a diode. This means it can be switched between conductive and non-conductive states based on a DC voltage level. If the DC voltage exceeds the turn on voltage, the diode will conduct. This means the connecting units may be switched in a passive way (i.e. without needing additional control lines) based on the applied antenna driving signal.

It would however be possible to provide actively switched RF switches such as transistors on the second PCB layer, so that there are no constraints placed on the drive levels to be applied to the antenna structure.

In one preferred implementation, the 2.4 GHz loop antenna and its near field functionality is provided on an LED board.

By implementing the RF switch 66 as an LED, the inherent switching function of an LED is used so that the RF switches do not need to be provided as separate elements. If there is a forward DC voltage, then the LED is on, and at this time the antenna becomes connected as a normal 2.4 GHz loop antenna, for the long range mode. The antenna feed-in signal can be an AC component to be superimposed on the forward DC forward voltage. If there is no DC forward voltage, the LED is turned off, so the antenna is segmented as a 2.4 GHz near field antenna.

The LED forward voltage is a DC voltage, whereas the antenna drive signal is a high frequency AC voltage. There may some flicker on the LEDs when adding the AC voltage to the DC voltage bias, but this will not influence the general turn on of the LEDs, and there will be no visible effect on the light output if the AC voltage is high frequency.

To drive the antenna in this case, a controller may be provided for controlling the connecting units to be in the first or second mode. The controller is adapted to provide a bias DC voltage across the series arrangement of diodes higher than the combined forward voltages of the diodes so as to control the connecting units to be in the conductive state. If there is no such forward DC voltage, the connecting units will be in the reactive state. By way of example, the DC forward voltage for each LED may be 3V.

The number of sections in the loop is preferably at least 8. For example 7 switching diodes may be used (to give 8 segments) giving an overall DC forward voltage of at least 21V. When in the long range communication mode, the LEDs around the antenna need to be turned on at all times to enable the antenna and hence communication function. For a luminaire with dimming capability, other LEDs of the luminaire may be used to implement the dimming. Thus, the lowest dimming setting may correspond for example to the 7 LEDs of the 8 segment loop being turned on.

Thus, an overall LED lighting circuit may comprise the antenna structure described above, which implements a first set of LEDs, and a dimming interface to receive a dimming signal. There is also an additional set of LED chips. Thus, the LED lighting circuit is adapted to turn on the LED chips in the antenna structure so as to emit light for all dimming levels, and hence to enable communication in the first signal range, and to turn on or off the additional set of LED chips according to said dimming signal.

The bias DC voltage comprises the drive voltage for driving the LEDs to emit light. A communication circuit then applies, upon the bias DC voltage, a superposed AC signal component for communication using the loop antenna in the first (long range) mode. Thus, there is an AC antenna drive signal superposed on a DC LED drive signal.

The antenna structure is able to transmit or receive signals in the same frequency band in the first and second modes. As explained above, the frequency band may include 2.4 GHz. However, the concept of the invention can clearly be applied to antenna structures designed for other frequencies. The size of the loop will be designed, in known manner, taking into account the target operating frequency.

The use of an LED as an RF switch requires the parasitic impedances at high frequency to be sufficiently low. Thus, for current implementations it may still be preferred to use dedicated RF diodes (or indeed transistors) as the connecting units. As LED technology develops and the parasitic impedances of LEDs at high frequency gets lower, LEDs will also become more suitable for being used as the RF switch.

Figure 8:
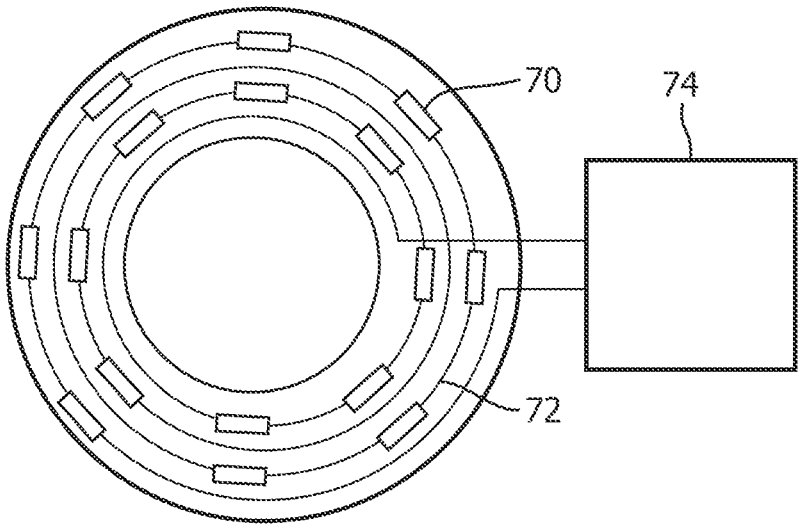
FIG. 8 shows an LED circuit comprising a set of LED chips formed around a conductor track on a PCB.

FIG. 8 shows an LED circuit comprising a set of LED chips 70 formed around a conductor track 72 on a PCB. The conductor track 72 defines the antenna, and the LED chips 70 define (in part) the connecting units. FIG. 7 also shows the controller 74 for driving the antenna and LEDs with a superposed DC LED drive level and AC communications signal.

Figure 9:
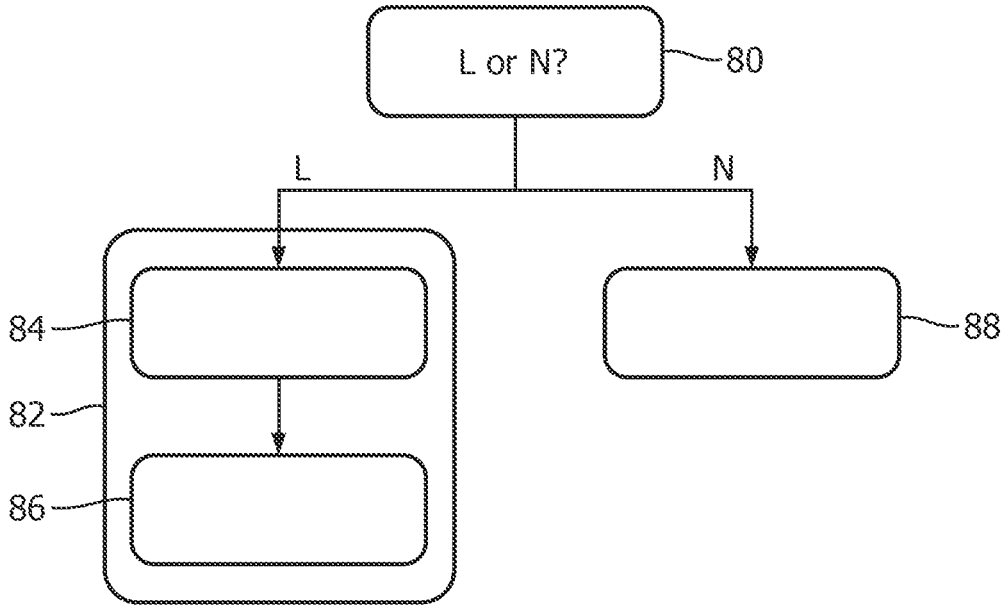
FIG. 9 shows a communication method.

FIG. 9 shows a communications method for use with the antenna structure described above.

In step 80, a choice is made between a long range, first mode (L) or a near field, second mode (N).

For the first mode of operation, the connecting units are controlled in step 82 to be in their conductive state thereby connecting the wire segments to form a loop antenna with a first signal range.

This involves applying a DC bias in step 84 and an AC communication signal in step 86 for communicating over the first signal range.

For the second mode of operation, the connecting units are controlled in step 88 to be in their reactive state thereby to form an antenna structure with a second signal range smaller than the first signal range. This involves applying an AC communication signal in step 88 for communicating over the second signal range with no DC bias. This for example comprises communication for a commissioning process of a lighting system. Communicating in the first and second modes of operation is in the same frequency band.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. An antenna structure comprising:

a plurality of wire segments formed in a loop;

a plurality of connecting units adapted to connect the plurality of wire segments, each of said connecting units being switchable between a conductive state and a reactive state, wherein said reactive state is adapted to introduce a reactive element for a phase delay between the adjacent wire segments, and said conductive state is adapted to introduce an element to bypass the reactive element;

wherein the antenna structure is switchable between a first and second mode of operation, wherein in said first mode, the connecting units are adapted to be in the conductive state thereby connecting the wire segments to form a loop antenna with a first signal range, and wherein in said second mode, the connecting units are adapted to be in the reactive state thereby to form an antenna structure with a second signal range smaller than the first signal range.

2. The antenna structure as claimed in claim 1, for transmitting or receiving signals in a frequency band, wherein the frequency band is the same for the first and second modes.

3. The antenna structure as claimed in claim 2, wherein the frequency band includes 2.4 GHz.

4. The antenna structure as claimed in claim 1, wherein the first mode is a long range communication mode and the second mode is a near field commissioning mode.

5. The antenna structure as claimed in claim 1, wherein the reactive state defines a capacitive coupling.

6. The antenna structure as claimed in claim 1, wherein each connecting unit comprises a parallel connection of an RF switch as the element to bypass the reactive element and a capacitor as the reactive element, wherein the RF switch is adapted to be closed to set the connecting unit in the conduction state, and open to set the connecting unit in the reactive state.

7. The antenna structure as claimed in claim 6, further comprising a single antenna feeding point on the loop for both of the first and the second modes, wherein one of the connecting units is opposite to the antenna feeding point on the loop, and further comprises a resistor in parallel with said capacitor.

8. The antenna structure as claimed in claim 6, wherein each connecting unit is formed on a double layer printed circuit board, wherein the RF switch is formed in a first layer of the printed circuit board, and the capacitor is formed in a second layer of the printed circuit board, and the RF switch and the capacitor are connected by a metalized via arrangement through the printed circuit board.

9. The antenna structure as claimed in claim 6, wherein each RF switch is a diode.

10. The antenna structure as claimed in claim 9, wherein each diode is a light emitting diode of a LED chip thereby to form an integrated light source and antenna architecture.

11. The antenna structure as claimed in claim 10, wherein the wire segments comprise the wiring between LED chips, which wiring is adapted to carry the LED chip current.

12. The antenna structure as claimed in claim 10, further comprising a controller for controlling the connecting units to be in the first or second mode, wherein said controller is for providing a bias DC voltage across the diode higher than a forward voltage of the diodes so as to control the connecting units to be in the conductive state, or otherwise to be in the reactive state, and a communication circuit for applying, upon the bias DC voltage, an AC signal component for communication using the loop antenna with the first signal range in the first mode.

13. A LED lighting circuit, comprising:

the antenna structure as claimed in claim 10;

a dimming interface to receive a dimming signal; and an additional set of LED chips;

wherein the LED lighting circuit is adapted to turn on the LED chips in the antenna structure so as to emit light and enable communication in the first signal range, and turn on or off the additional set of LED chips according to said dimming signal.

14. The LED lamp, comprising the LED lighting circuit as claimed in claim 13.

15. A communications method, comprising:

providing an antenna structure comprising:

a plurality of wire segments formed in a loop; and a plurality of connecting units adapted to connect the plurality of wire segments, each of said connecting units being switchable between a conductive state and a reactive state, wherein said reactive state is adapted to introduce a reactive element for a phase delay between the adjacent wire segments and said conductive state is adapted to introduce ane element to bypass the reactive element, wherein the method comprises:

in a first mode of operation, controlling the connecting units to be in their conductive state thereby connecting the wire segments to form a loop antenna with a first signal range, and communicating over the first signal range; and in a second mode of operation, controlling the connecting units to be in their reactive state thereby to form an antenna structure with a second signal range smaller than the first signal range, and communicating over the second signal range;

wherein the communicating in the first and second modes of operation is in the same frequency band including 2.4 GHz, and the first mode is a long range communication mode and the second mode is a near field commissioning mode.

* * * * *